US005291907A

United States Patent [19]

Clark

[11] Patent Number: 5,291,907

[45] Date of Patent: Mar. 8, 1994

[54] SCUBA EQUIPMENT RINSE NOZZLE

[76] Inventor: Raymond S. Clark, 124 Park Rd., Fort Mitchell, Ky. 41011

[21] Appl. No.: 955,050

[22] Filed: Oct. 1, 1992

[51] Int. Cl.[5] ..... B08B 3/04; B08B 9/00

[52] U.S. Cl. ..... 134/166 R; 134/182; 134/198; 239/552; 239/562

[58] Field of Search ..... 134/154, 166 R, 169 R, 134/182, 198, 201; 239/552, 553, 562

[56] References Cited

U.S. PATENT DOCUMENTS

| | | | |
|---|---|---|---|
| 172,467 | 1/1876 | Melcher . | |
| 655,879 | 8/1900 | Lisk . | |
| 895,955 | 8/1908 | Brown . | |
| 1,085,052 | 1/1914 | Lunney . | |
| 1,351,368 | 8/1920 | Burns . | |
| 1,419,106 | 6/1922 | Bentley . | |
| 1,484,512 | 2/1924 | Lightfoot . | |
| 1,560,903 | 11/1925 | Eiche . | |
| 1,659,095 | 2/1928 | Goodloe . | |
| 1,916,912 | 7/1933 | Armstrong . | |
| 2,003,052 | 5/1935 | Lord . | |
| 2,025,767 | 12/1935 | Meng . | |
| 2,171,023 | 8/1939 | Buxton . | |
| 2,249,274 | 7/1941 | Faine . | |
| 2,443,355 | 6/1948 | Manning . | |
| 2,470,940 | 5/1949 | Mosher . | |
| 2,552,352 | 5/1951 | Swanson . | |
| 2,632,450 | 3/1953 | Allen . | |
| 2,636,502 | 4/1953 | Buechel | 134/166 R X |
| 3,831,860 | 8/1974 | Gullaksen . | |
| 3,937,404 | 2/1976 | Johnson . | |
| 4,537,360 | 8/1985 | Bock . | |
| 4,702,267 | 10/1987 | Ashraff . | |
| 4,941,492 | 7/1990 | Morgan | 134/182 |
| 4,949,739 | 8/1990 | Ryan . | |
| 4,969,666 | 11/1990 | McMillen et al. . | |
| 4,989,624 | 2/1991 | Darling . | |
| 5,037,487 | 8/1991 | Santos . | |

FOREIGN PATENT DOCUMENTS

| | | | |
|---|---|---|---|
| 231021 | 12/1985 | German Democratic Rep. | 134/198 |

*Primary Examiner*—Philip R. Coe
*Attorney, Agent, or Firm*—Wood, Herron & Evans

[57] ABSTRACT

A rinse nozzle for gently and efficiently rinsing the interior and exterior of breathing regulators, snorkels, buoyancy compensator vests and other SCUBA equipment. The nozzle has an outlet adapted to releasably mate with regulator and snorkel mouthpieces and with the mouthpiece of a buoyancy compensator inflator. The nozzle includes a flow metering means, baffle means, and diffusing passage to provide low velocity fluid rinsing to prevent damage to the equipment. The rinse nozzle can be attached to any standard hose or faucet.

23 Claims, 3 Drawing Sheets 2A
3
10

SCUBA EQUIPMENT RINSE NOZZLE

FIELD OF THE INVENTION

This invention relates generally to apparatus for rinsing SCUBA equipment, and more particularly to apparatus for gently rinsing and cleaning SCUBA regulators, snorkels and buoyancy compensators and other SCUBA related equipment.

BACKGROUND

SCUBA equipment, and particularly self-contained underwater breathing apparatus, is frequently used under conditions where cleaning or rinsing immediately after use is necessary. Such equipment, for example, generally includes SCUBA breathing regulators, snorkels and buoyancy compensators. SCUBA regulators, of course, are the equipment which enable a diver to breathe underwater. They usually are provided in a unit comprising a first stage for stepping down high pressure air to a lower pressure and a second stage for controlling the air supplied for breathing on demand. These devices usually comprise a mouthpiece and a large diaphragm connected to a valve lever, providing an on demand breathing apparatus. Snorkels, of course, are devices having a mouthpiece and a curved breathing tube which permits a person to float on the water's surface and view downwardly without twisting the head for breathing. Buoyancy compensators, on the other hand, generally comprise inflatable vests which are worn by divers to adjust their buoyancy. These vests may be inflated either orally or by power inflators connected to the low pressure outlets of the first stage of the SCUBA regulator. The oral inflation devices usually comprise a hose having a mouthpiece at one end with a valve which can be operated while underwater to permit the introduction of air into the buoyancy compensator vest by the diver orally.

It is essential that such SCUBA equipment be cleaned or rinsed after use, not only to extend its useful lifetime, but also to ensure that it will not fail during subsequent use, which could be a potentially life-threatening occurrence. This need for cleansing is particularly acute when SCUBA equipment is used in salt water, for example. Once salt water dries, it leaves a salt residue, which can be both corrosive and abrasive. These effects can shorten the useful life or interfere with the performance of the life support equipment. For example, salt left in the second stage of a breathing regulator may interfere with the valve operation or corrode the metallic valve parts. Dried salt crystals can also accumulate on the diaphragm and cause undue wear during subsequent uses.

It is also common for at least some salt water to enter a buoyancy compensator, for example, through the mouthpiece of the inflator. When such salt water dries inside the compensator, it leaves a salt residue, particularly in the bottom creases and seams of the inflatable bladder. The effects of dried salt can cause undue wear within the compensator wall, and possibly result in material failure. This could result in air leaks and the ingestion of water during a dive, reducing the lift capacity of the BC.

In the usual method of cleaning or rinsing such equipment, an ordinary garden hose or faucet is used to rinse the equipment, either at the dive site, boat dock, or later at home or lodging. Although this method appears to be quick and easy, it suffers from two major shortcomings.

First, the water flowing through a garden hose or faucet is at relatively high speed and under high pressure, particularly when a nozzle of the normal garden hose variety is utilized. When such high speed streams are directed onto regulators, buoyancy compensators or snorkels, the high velocity streams can damage the equipment. Such high velocity streams could bend or break a valve component in the regulator, tear or unseat diaphragms or the like.

To prevent damaging the diaphragms and valve mechanisms of the second stage of a breathing regulator, extreme care must be exercised during the rinsing process. As a result, the breathing regulator often receives an inferior cleaning, or is not cleaned at all. Moreover, the water splash from a hose at the rinsing site may wet everything in the rinse area.

Secondly, in cleaning such equipment, it is often necessary to ensure that water flows through or into the device in order to cleanse the interior. Currently, it is necessary to distort and stretch the mouthpieces associated with these devices over the threaded end of a hose or faucet to accomplish this task. However, this practice causes the mouthpiece to quickly wear, or may even result in permanent damage to the mouthpiece, not to mention the potential damage from potentially high water velocity against sensitive components. Accordingly, it has been one objective of this invention to provide a nozzle for gently rinsing or cleaning SCUBA equipment.

A further objective of the invention has been to enable the use of a high pressure water source, such as a typical consumer water supply, in cleaning or rinsing delicate SCUBA equipment parts without damaging such apparatus.

BRIEF DESCRIPTION OF THE INVENTION

To these ends, a preferred embodiment of the present invention comprises a rinse nozzle having means for connecting the nozzle to the end of a garden hose or faucet with a normal water supply, and means therein for reducing the normally high velocity, water stream into a much lower velocity water stream, which can be used to gently rinse SCUBA equipment without damage thereto. The rinse nozzle, according to the invention, is provided with an end which is particularly adapted for mating with the mouthpieces of certain SCUBA equipment, including for example, breathing regulators, snorkels and oral inflators of buoyancy compensators. The nozzle includes a tube-like protrusion for engaging with the typical mouthpiece, together with other surfaces which mate with the mouthpiece to provide a leak free connection between the nozzle and the mouthpiece. Cut outs in the nozzle accommodate the normal bite projections on the mouthpieces, so that the nozzle can be completely sealed to the mouthpiece.

Such a rinse nozzle can be attached to any standard garden hose or faucet. The nozzle preferably includes a built-in shut-off valve, which permits the nozzle to be used without any other specialized equipment and without nearby access to the hose spigot, for example. Rinse water can be conducted through the nozzle or stopped by operation of the shut-off valve. Internally, the nozzle includes a flow metering aperture, a fluid accumulation chamber, baffle means or diffusing passage and a mouthpiece adapter. In use, water flows through an inlet end of the nozzle and through the flow metering aperture into the accumulation chamber, where the stream of water impinges on a perpendicular upstream face of the baffle means and fills up the chamber. Outer surfaces of the baffle are curved to mate with internal surfaces of the nozzle or the mouthpiece adapter, and water flows over these surfaces resulting in a lower velocity and water flow through the mouthpiece adapter and into any SCUBA equipment associated with the mouthpiece adapter. It will be appreciated that the baffle means and its downstream surfaces prevent fluid stalling effects in the diffuser tube, even at high flow rates. The baffle means serves to spread fluid flow over the entire cross-section of the diffuser passageway, reducing the energy of the flowing fluid and making it safe to rinse delicate SCUBA equipment with normal water pressure available at docks, homes, lodgings, etc. The normal high velocity stream introduced to the nozzle by the garden hose or faucet, for example, is thus diffused and lowered in velocity, so that gentle rinsing or cleaning of the SCUBA equipment can be accomplished.

DESCRIPTION OF THE DRAWINGS

These and other modifications and objectives will readily appear from the following detailed description of a preferred embodiment of the invention and from the drawings, in which.

DETAILED DESCRIPTION OF THE PREFERRED EMBODIMENT

Figures 1, 2, 2A, 3:
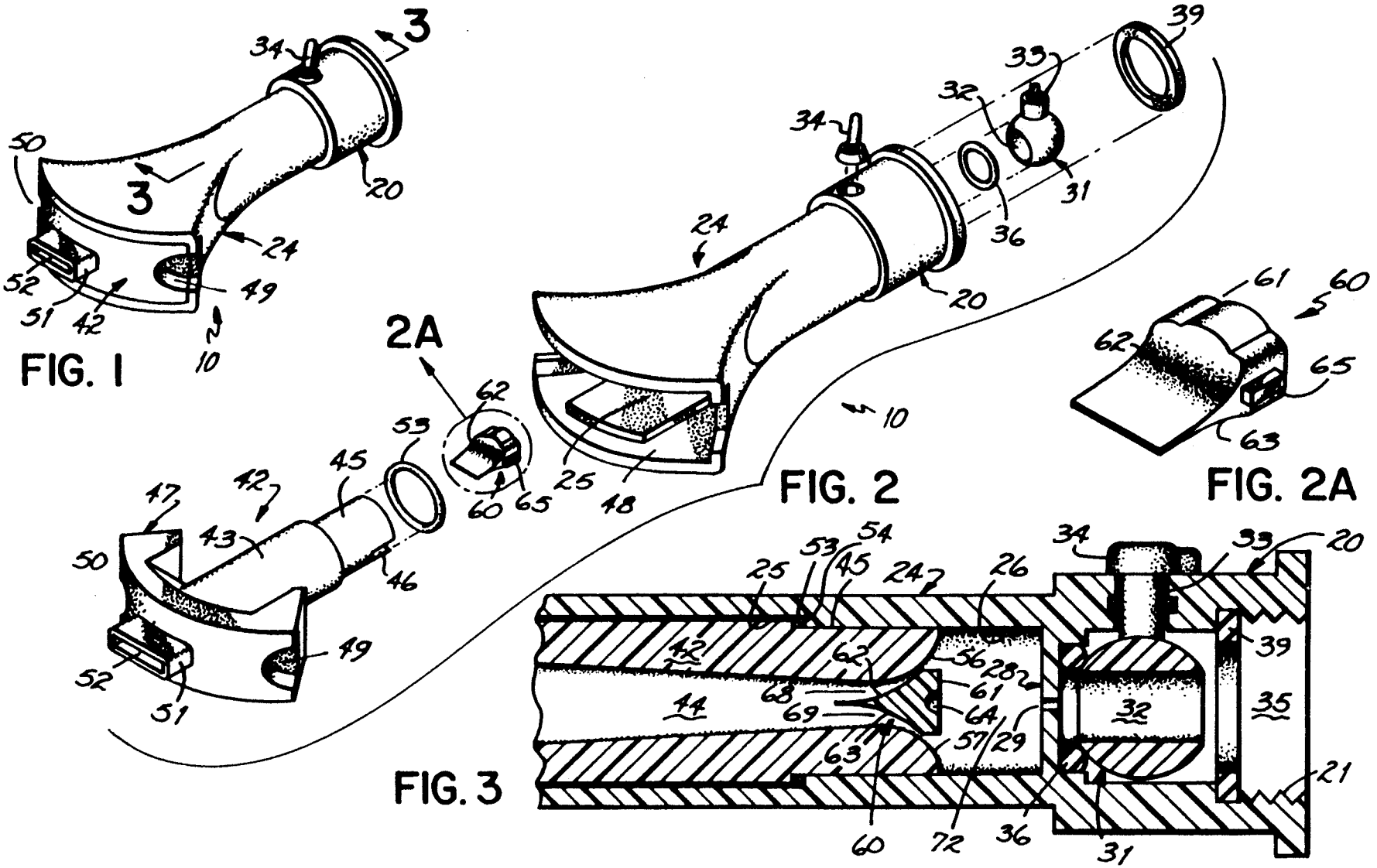
FIG. 1 is a perspective view of the assembled rinse nozzle, according to a preferred embodiment of the invention.
FIG. 2 is a perspective exploded view of the rinse nozzle of FIG. 1.
FIG. 2A is an enlarged view of the baffle shown in FIG. 2.
FIG. 3 is an enlarged cross-sectional view of the invention taken along lines 3—3 of FIG. 1.

The details of a rinse nozzle 10 are perhaps best seen in FIGS. 1 through 3. It will be appreciated that the term "nozzle" is used herein to refer the apparatus 10 which is adapted for fitting on the end of a hose 11 (FIGS. 4–6) to control the effluent therefrom for rinsing and cleaning SCUBA equipment, as will be described.

Figure 7:
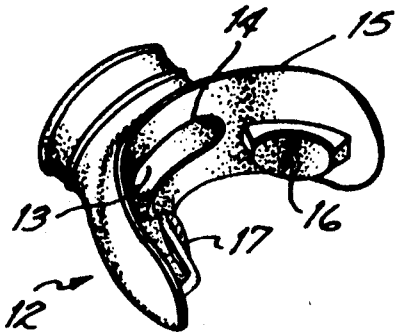
FIG. 7 is a perspective view of a SCUBA mouthpiece such as that in FIG. 4.

It will also be appreciated that the rinse nozzle 10 is particularly adapted for use with SCUBA equipment having a typical SCUBA mouthpiece thereon. The details of such a mouthpiece are perhaps best seen in FIG. 4 and in FIG. 7. There, a mouthpiece 12 has a tubular air passageway 13 communicating with an opening 14 in a curved shield 15. Bite projections 16 and 17 are disposed on each side of the opening 14 and can be gripped by a user's teeth to maintain the mouthpiece 12 in position. The mouthpiece is generally held onto a regulator snorkel or other apparatus by means of a tie wrap 18. The lips of a user surround this shield 15, so as to provide an airtight seal with the user's mouth. Such mouthpieces generally are made of a highly resilient material, and generally come in several slightly different sizes and configurations, but having the essential elements as described above. The rinse nozzle 10, according to the preferred embodiment of this invention can be is used in order to clean and rinse equipment on which such mouthpieces are used.

Returning now to FIG. 1, details of the rinse nozzle 10 will be further described. The nozzle 10 generally has a circular boss 20 internally threaded as at 21 (FIG. 3) for connection of the nozzle to a garden hose 11 (FIGS. 4–6) or to a faucet (not shown) or to some other typical means for supplying water or cleaning fluid through or to the nozzle. Extending downstream of the circular boss 20 is a flared housing 24. Flared housing 24 has opposed internal surfaces **25*a* and 25*b* communicating with the interior of the circular boss 20 via a cylindrical portion or bore 26. The flared housing 24 also includes a wall 28 defining flow metering aperture 29 in communication on one side with the interior of the circular boss 20 and on the other side with the bore 26**.

A ball valve is disposed within the circular boss 20 and comprises a ball member 31, having a bore 32 therein and an actuating stem 33 with actuator 34 for turning the ball member so that the aperture 32 can be lined up with the inlet 35 in the cylindrical boss 20 and the flow aperture 29 so that fluid can pass therethrough. The ball 31 is sealed to the housing by means of an "O"-ring 36. A resilient washer 39 is also provided in circular boss 20 for sealing the end of the garden hose fitting to the nozzle 10.

A mouthpiece adapter 42 is disposed within the flared housing 24 of the nozzle 10. The mouthpiece adapter includes a cylindrical portion 43 having a diffuser passage 44 therethrough, and terminating in a stepped down cylindrical portion 45 having a plurality of relieved slots 46 opened at the end of portion 45. The mouthpiece adapter also includes a flange 47 for mating with the flared opened end 48 of the flared housing 24. The flange 47 is provided with bite projection cut outs 49 and 50, and a protruding tubular element 51, having a rectangular opening 52 in communication with a diffuser passage 44 of the mouthpiece adapter 42. As shown in FIG. 3, the mouthpiece adapter 42 is fitted internally with the nozzle 10, such that the step down cylindrical portion 45 slides within the internal bore 26 of the flared housing 24. The larger cylindrical portion 43 of the mouthpiece adapter 42 fits within the interior surfaces **25*a* or 25*b* of the flared housing 24. The shoulder formed at the juncture of cylindrical portions 43 and 45 is sealed by "O"-ring or washer 53 to a shoulder 54 within the flared housing 24**.

It should also be appreciated that the diffuser passage 44 of the mouthpiece adapter 42 is open through the rear end of the cylindrical step down portion 45 and, in fact, the diffuser passage 44 is defined at its upstream end by the opposed curved surfaces 56 and 57, which provide a flared opening to the diffuser passage 44, which is preferably generally rectangular in cross-section.

A diffusing baffle means 60 has an upstream face 61 and two curved downstream surfaces 62 and 63. A dimple or concavity 64 is formed in the upstream face 61 of the diffusing baffle 60. An elongated projection 65 is formed on each side of the diffusing baffle 60. These elongated projection 65 mate with the slots 46 in the cylindrical portions 45 of the mouthpiece adapter 42 to accurately position the diffusing baffle 60 and to limit the extent of its insertion into the cylindrical portion 45 and diffuser passage 44. The baffle means 60 may have rounded sides to fit with rounded side surfaces within cylindrical portion 45.

When the diffusing baffle 60 is in its appropriate position, it will be appreciated that its surfaces 62 and 63 cooperate respectively with the surfaces 56 and 57 to define diverging passageways 68 and 69 therebetween feeding into diffuser passage 44.

It will be further appreciated that the flared housing 24 has defined therein an accumulation chamber 72 between the metering aperture 29 and the diffusing baffle 60 and end of cylindrical projection 45.

It will be appreciated that the rinse nozzle 10 can be utilized with a source of high pressure, high velocity fluid such as water, from a typical public water supply system. When the ball 31 is in the position shown in FIG. 3 and the nozzle is attached to a garden hose 11 (FIGS. 4–6) water moves through the bore 32 and the ball to the flow aperture 29. A stream of water passing through the aperture 29 impinges on the dimple or concave portion 64 of the diffusing baffle 60 and fills the accumulation chamber 72. As water fills the accumulation chamber 72, it moves through the passages 68 and 69, into the preferably diverging rectangular diffuser passage 44 and from there to the rectangular opening 52 and the tubular portion 51 at the downstream-most end of the nozzle. Water emanating from the opening 51 is at low velocity or energy, useful for gently cleaning and rinsing SCUBA equipment without causing damage thereto. The surfaces 62, 63 of the baffle serve in conjunction with surfaces 56 and 57 to prevent or reduce any "stalling" of the water as it is dispersed along the diverging surfaces 56*a* and 57*a*.

Figure 4:
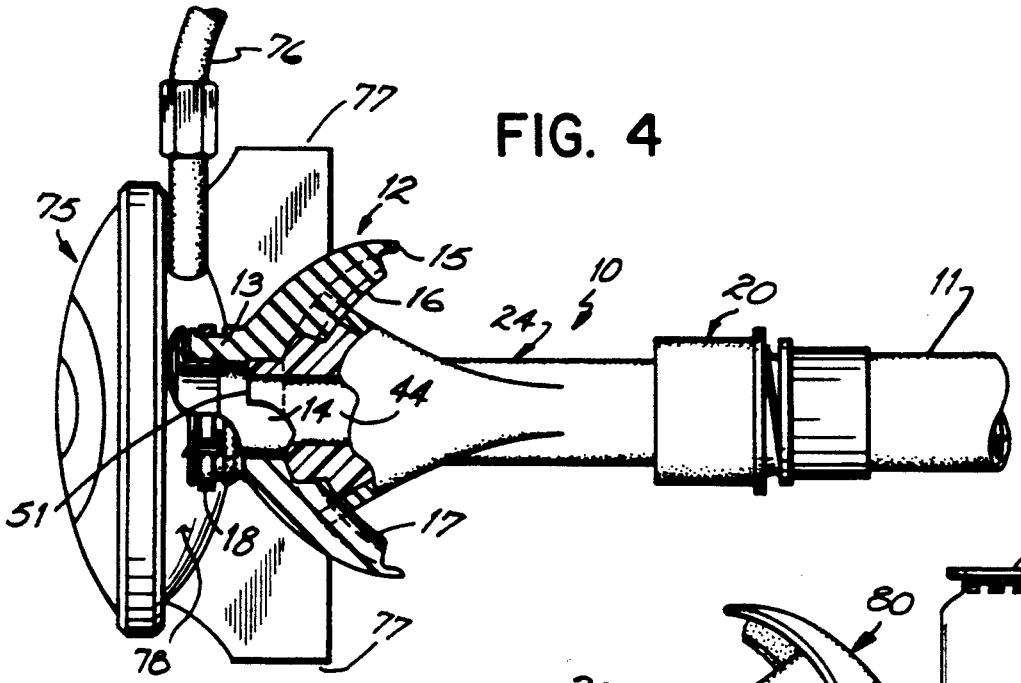
FIG. 4 is a top plan view, in partial cross-section, showing the rinse nozzle attached to a garden hose and also operably assembled to the second stage of a breathing regulator.
Figure 5A:
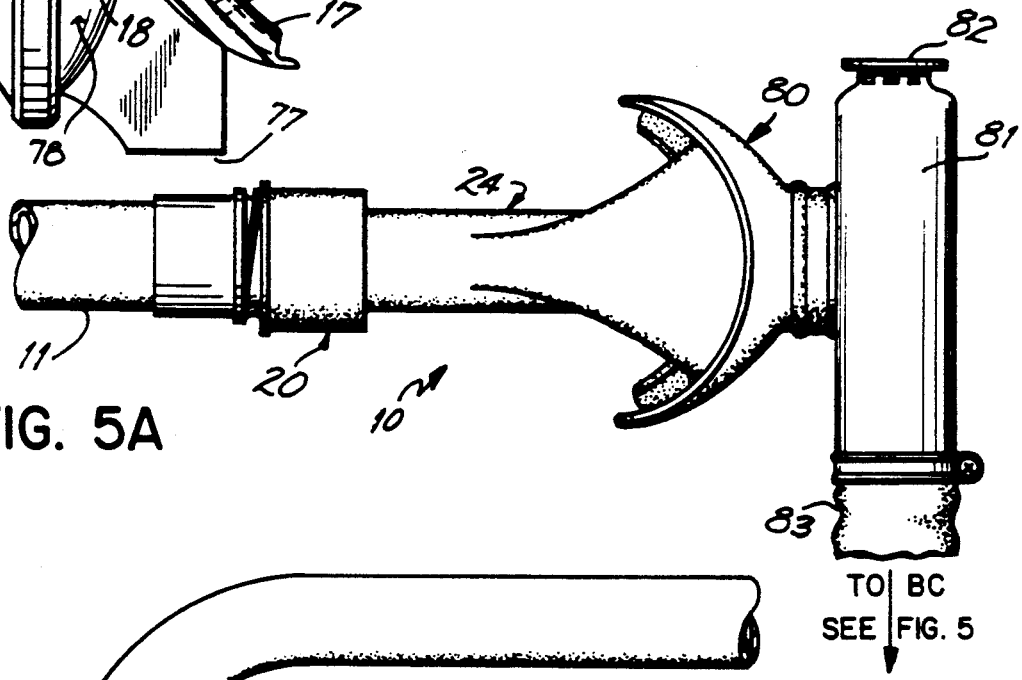
FIG. 5A is an enlarged view of the encircled area of FIG. 5.

Turning now to exemplary uses of the nozzle 10, and with first reference to FIG. 4, it will be appreciated that the nozzle 10 is shown in operative communication with a mouthpiece 12. Of course, the nozzle 10 could be utilized with other mouthpiece configurations, such as without bite projections.

As shown in FIG. 4, the tube 51 of the nozzle 12 has been inserted into the opening 14 of the mouthpiece. The bite projections 16 and 17 of the mouthpiece are accommodated in the bite projection cut outs 49 and 50 in the mouthpiece adapter 42 of the nozzle 10. Moreover, since it will be appreciated that the flange 47 of the mouthpiece adapter 42 has an outwardly curved face, that face mates with the interior surface of the shield 15 to provide a relatively watertight fitting between the nozzle 10 and the mouthpiece 12 without undue stress to the mouthpiece body. It will be appreciated it is not necessary to produce a perfect watertight fitting in this regard, but it is desirable to couple the nozzle 10 to the mouthpiece so that the water flow is primarily directed into the mouthpiece opening 14 and to the equipment with which the mouthpiece is associated.

In FIG. 4, it will be appreciated that the mouthpiece 12 is operably connected to a housing 78 of a second stage 75 of a SCUBA breathing regulator. The second stage 75 is connected to a high pressure first stage by means of a hose 76, interconnected to the second stage 75. A diaphragm in the housing 78 is interconnected to a valve situated at the discharge end of the hose or fitting 76 in the second stage. The second stage also has exhaust outlet 77 interconnected with the housing 78 to which the mouthpiece is connected. In normal use of the second stage regulator 75, a user may breathe in through the mouthpiece, which will open the valve, and admit pressurized air in hose 76 into the chamber for breathing. When the user breathes out, the diaphragm in the regulator closes the valve, cutting off the air supply and the higher pressure in the chamber of the regulator then exhausts through the outlet 77.

When the nozzle 10 is connected to the mouthpiece 12, however, and the water flow turned on, a gentle stream of water emanates from the nozzle 10 through the tube 51 into the mouthpiece and into the regulator, where the water gently flows over the internal parts of the regulator cleansing and rinsing it internally. The water exudes through the exhaust 77 and rinses the exhaust valves and components as well.

During this operation, of course, the ball 31 can be turned to start or to stop the flow of water through the nozzle 10 as is desired. Thus, the regulator can be effectively rinsed and cleaned with little splashing. Also, it will be appreciated that it is not necessary to stretch the mouthpiece over the threaded fitting end on the garden hose or nozzle, for example. Through the use of the nozzle 10, the mouthpiece and the regulator are protected from a high velocity, stream of water which might damage the diaphragm or valve components or regulator parts. The flow through the nozzle 10 is maintained at a low rate and is easily ported through the exhaust valves without significant pressure buildup in the second stage and which is insufficient to damage unseat the components of the second stage regulator.

Figure 5:
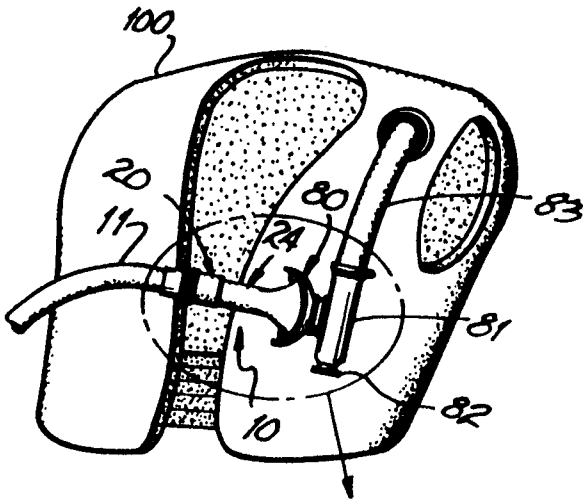
FIG. 5 is a perspective view of the rinse nozzle of FIG. 1 connecting a garden hose to a buoyancy compensator.

Turning now to FIG. 5, the nozzle 10 is shown associated with the mouthpiece 80, attached to the inflator 81 of a BC 100. The mouthpiece 80 may be similar to the mouthpiece 12, but varies with manufacturer design. The inflator 81 has at least a control button 82 for controlling the inflator to permit the oral inflation and deflation of the BC through the mouthpiece 80. In other words and in use, the BC, which is interconnected to the inflator through the hose 83, can be inflated or deflated while under water orally by the diver. For example, the diver would remove the second stage regulator from his mouth, push the control 82 and breathe into the mouthpiece 80. This method would inflate the BC through the hose 83. The inflator may also be provided with a second control (not shown) for inflating the BC through the hose 83 by means of the SCUBA tank and an interconnection therefrom. Whether the power inflator 81 is provided with a tank inflation capacity or simply an oral capacity, it will be appreciated that the nozzle 10 can be associated with the mouthpiece 80 to rinse the inflator portion of a BC, and as well to introduce cleansing rinse water through the hose 83 into the BC jacket itself for rinsing the inside of the BC and cleaning it, for example, of any salt water therein prior to the time that that water dries and leaves any salt residue. In this regard, attaching the nozzle to the mouthpiece 80 and depression valve 82 will allow a gentle water flow into the BC.

Accordingly, it will be appreciated that similar advantages are obtained when using the rinse nozzle 10 with an inflator for a BC. A gentle rinse stream is provided and high velocity streams are avoided, eliminating damage to the inflator or to the BC. In addition, it is not necessary to stretch the mouthpiece 80 over a faucet or hose fitting, for example.

Figure 6:
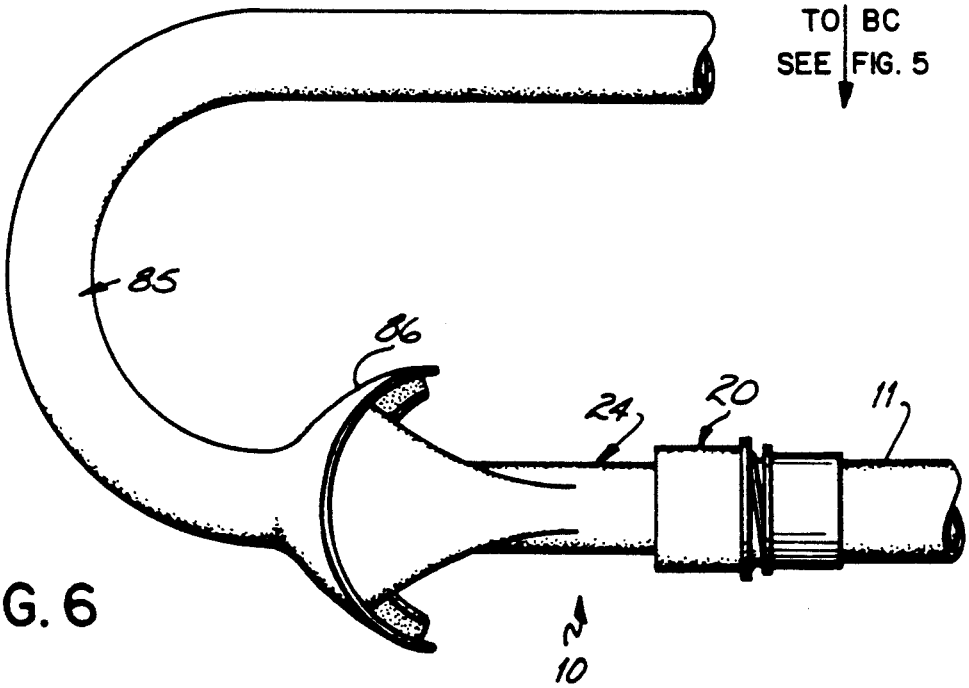
FIG. 6 is a top plan view showing the preferred embodiment of the rinse nozzle attached to a garden hose and operably associated with a snorkel.

Turning now to FIG. 6, there is illustrated therein the utilization of the nozzle 10 for rinsing a snorkel 85 having a mouthpiece 86. The mouthpiece 86 is typically identical to mouthpiece 12 and it is only necessary to interconnect the nozzle 10 with the mouthpiece 86 as described above with respect to the other mouthpieces, to turn the water on and to rinse the snorkel 85 with a gentle, low velocity stream of water.

Accordingly, it will be appreciated that the rinse nozzle 10 provides a diffusing means for diffusing a high velocity water stream into a low velocity stream or plurality of streams for gently rinsing and cleansing SCUBA equipment. This is most easily done through the use of an ordinary garden hose with a nozzle 10 attached thereto and interconnected with a water supply at a dock, diving facility or at the lodging of the SCUBA equipment user. Moreover, it will be appreciated that the nozzle 10 provides means to facilitate the utilization of a hose or faucet supply of water for cleaning or rinsing SCUBA equipment, the nozzle being particularly adapted for fitting with the mouthpiece used on snorkels, BC, regulators and the like. Their cleaning and rinsing is thus greatly facilitated, whereas in the past, these devices were cleaned either by dunking them in a container of water or by holding them under the flow of water from a faucet or the like, which is cumbersome, may not provide adequate water flow for thorough rinsing of the equipment, or may damage the equipment.

It should also be appreciated that the nozzle could be utilized with fluid other than water supply, for example, cleaning fluid or the like, where that is desired.

Also, it will be appreciated the nozzle described herein can be used with various forms of SCUBA equipment or underwater breathing equipment having mouthpieces such as two hose regulators, surface supplied air equipment or the like.

It will be further appreciated that the outlet end of the nozzle can be provided with only one or more recesses or configurations to complement and mate with various types and forms of mouthpieces. This includes, for example, a mouthpiece having a bridge thereacross for comfortable biting and holding purposes, moldable mouthpieces and the like.

These and other modifications and advantages will be readily appreciated by those of ordinary skill in the art without departing from the scope of the invention herein, and applicant intends to be bound only by the claims appended hereto.

I claim:

1. A rinse nozzle for rinsing SCUBA and snorkeling equipment having a mouthpiece, said nozzle comprising:

fluid inlet means at a first end thereof for connecting said nozzle to a fluid supply and means at a second end thereof for operably mating said nozzle with a mouthpiece;

a fluid passageway extending through said nozzle;

a fluid outlet means in communication with said fluid passageway;

means for metering the flow of fluid through said fluid passageway; and said passageway comprising a fluid diffusing passageway downstream of said metering means for diffusing the flow of said fluid to said outlet means.

2. The rinse nozzle of claim 1 wherein said means for diffusing the flow of said fluid comprises:

a baffle means located within said fluid passageway; and a plurality of diverging fluid conduits along the periphery of said baffle means defining portions of said fluid passageway.

3. The rinse nozzle of claim 2 wherein said baffle means comprises:

a substantially blunt upstream surface substantially perpendicular to the flow of the fluid emerging from said metering means for deflecting said fluid.

4. The rinse nozzle of claim 3 wherein said baffle means further includes converging downstream surfaces forming, with upstream portions of said fluid passageway, said diverging fluid conduits for dispersing said fluid passing through said diverging fluid conduits downstream therefrom.

5. The rinse nozzle of claim 1, wherein said fluid inlet means is threaded for attaching said rinse nozzle to a fluid source.

6. The rinse nozzle of claim 1, wherein said means for metering the flow of said fluid comprises a wall perpendicular to said fluid passageway and defining therein an aperture for metering said flow.

7. The rinse nozzle of claim 6 further comprising a baffle means and a fluid accumulation chamber between said flow metering means and said baffle means.

8. A rinse nozzle as in claim 6 wherein said fluid passageway has a larger cross-section at said fluid outlet means than at said metering means.

9. A rinse nozzle as in claim 6 wherein said fluid passageway has a portion downstream of said metering means of progressively expanding cross-section.

10. A rinse nozzle as in claim 6 wherein said passageway diverges downstream of said metering means.

11. The rinse nozzle of claim 1, wherein said means for operably mating said nozzle with a mouthpiece comprises a convex surface facing outwardly of said nozzle.

12. The rinse nozzle of claim 11 including at least one recess in said convex surface for receiving a bite projection of a mouthpiece.

13. The rinse nozzle of claim 12 including a protruding fluid outlet tube extending downstream from said convex surface for directing fluid into said mouthpiece.

14. The rinse nozzle of claim 1, including a baffle means in said passageway and wherein said fluid passageway has a substantially constant cross-section portion upstream from said baffle means and diverges in cross-section downstream from said baffle means.

15. A rinse nozzle adapted for rinsing SCUBA and snorkeling equipment having mouthpieces thereon, said nozzle comprising:

a housing having a fluid inlet;

a mouthpiece adapter disposed in said housing and having a fluid inlet and a fluid outlet with a fluid passage therebetween;

said fluid outlet having means for mating with said mouthpieces;

a baffle means located in said fluid inlet of said mouthpiece adapter for directing the fluid flowing through said rinse nozzle;

a flow metering means upstream of said baffle means; and an accumulation chamber defined between said flow metering means and said baffle means, whereby fluid passing through said flow metering means traverses said accumulation chamber and strikes said baffle means.

16. The rinse nozzle of claim 15, wherein said baffle means comprises:

a substantially blunt upstream surface substantially perpendicular to flow of fluid passing through said flow metering means and traversing said accumulation chamber thereby deflecting said fluid;

a plurality of fluid conduits along the periphery of said baffle means in communication with said accumulation chamber and said fluid passage; and a plurality of diverging downstream surfaces defining a portion of said fluid passage and for dispersing said fluid passing through said fluid conduits over the entire cross-section of said fluid passage downstream of said baffle means.

17. The rinse nozzle of claim 16, wherein said fluid inlet of said housing is threaded for receiving a threaded hose fitting.

18. A rinse nozzle for rinsing SCUBA diving equipment having a mouthpiece, said nozzle comprising:

means for receiving a pressurized rinse fluid flow;

means for metering said pressurized rinse fluid flow;

means for diffusing a metered pressurized rinse fluid flow; and means for operably connecting said nozzle to the mouthpiece of SCUBA diving equipment for rinsing said equipment attached thereto with rinse fluid which is metered and diffused.

19. A rinse nozzle for rinsing SCUBA diving equipment through a mouthpiece associated therewith, said rinse nozzle means having:

means for connecting said rinse nozzle to a source of rinse fluid;

flow diffusing means for reducing the velocity of rinse fluid flowing from said source into said nozzle; and means for operably interconnecting said nozzle to a mouthpiece for supplying rinse fluid to the mouthpiece for rinsing said equipment.

20. A rinse nozzle of claim 1 further including a valve in said nozzle for selectively stopping flow of fluid therethrough.

21. A rinse nozzle for directing rinse water from a water hose for rinsing underwater breathing equipment having a mouthpiece thereon, said rinse nozzle comprising:

means for connecting said rinse nozzle to a water hose for receiving a flow of rinse water therefrom;

means for connecting said rinse nozzle to a mouthpiece connected to underwater breathing equipment; and means in said nozzle for diffusing flow of rinse water from a water hose prior to delivery of said flow to said mouthpiece.

22. A rinse nozzle as in claim 21 further including a valve in said nozzle for selectively shutting off flow of rinse water therethrough.

23. A rinse nozzle as in claim 21 wherein said means for connecting said rinse nozzle to said mouthpiece includes a curved outer surface for conforming to a mouthpiece.

* * * * *